US007971510B2

(12) United States Patent
Weber

(10) Patent No.: US 7,971,510 B2
(45) Date of Patent: Jul. 5, 2011

(54) METHOD FOR SETTING A CUTTING GAP

(75) Inventor: Günther Weber, Zachow (DE)

(73) Assignee: Weber Maschinenbau GmbH Breidenbach, Breidenbuch (DE)

( * ) Notice: Subject to any disclaimer, the term of this patent is extended or adjusted under 35 U.S.C. 154(b) by 1372 days.

(21) Appl. No.: 10/487,194
(22) PCT Filed: Aug. 12, 2002

(86) PCT No.: PCT/EP02/09025

§ 371 (c)(1),
(2), (4) Date: Feb. 19, 2004

(87) PCT Pub. No.: WO03/022537

PCT Pub. Date: Mar. 20, 2003

(65) Prior Publication Data

US 2004/0231476 A1 Nov. 25, 2004

(30) Foreign Application Priority Data

Sep. 5, 2001 (DE) ..... 101 43 508

(51) Int. Cl.
*B26D 7/26* (2006.01)
*B26D 1/24* (2006.01)

(52) U.S. Cl. ..... 83/13; 83/72; 83/76.6; 83/583; 83/522.12; 83/676; 83/932

(58) Field of Classification Search ..... 83/13, 663, 83/468.2, 932, 73, 77, 713, 69, 714, 62.1, 83/72, 14, 208, 703, 438, 75, 42, 365, 367, 83/167, 358, 363, 76.6, 676; 53/123, 544, 53/543, 542, 435, 53; 99/537; 408/8, 9, 408/2, 10, 13; 324/207, 226; 409/131, 186, 409/136, 193

See application file for complete search history.

(56) References Cited

U.S. PATENT DOCUMENTS

| | | | | | |
|---|---|---|---|---|---|
| 4,217,650 | A | * | 8/1980 | Kuchler | 702/175 |
| 4,295,420 | A | * | 10/1981 | Satake et al. | 99/486 |
| 4,440,530 | A | * | 4/1984 | Yamakage | 408/3 |
| 4,532,840 | A | * | 8/1985 | Antonissen | 83/76.8 |
| 4,592,259 | A | | 6/1986 | Gorner et al. | 83/13 |
| 4,598,618 | A | * | 7/1986 | Kuchler | 83/77 |
| 4,713,593 | A | * | 12/1987 | Rodi et al. | 318/572 |
| 4,934,232 | A | | 6/1990 | Weber et al. | 83/355 |
| 4,991,475 | A | * | 2/1991 | Malcok et al. | 83/13 |
| 5,002,440 | A | * | 3/1991 | Tamaoki et al. | 408/12 |
| 5,038,654 | A | * | 8/1991 | Mackey | 83/880 |
| 5,136,906 | A | * | 8/1992 | Antonissen et al. | 83/42 |
| 5,282,404 | A | * | 2/1994 | Leighton et al. | 83/13 |
| 5,535,654 | A | * | 7/1996 | Niesporek et al. | 83/364 |

(Continued)

FOREIGN PATENT DOCUMENTS

DE 2820618 12/1978

(Continued)

*Primary Examiner* — Ghassem Alie
(74) *Attorney, Agent, or Firm* — Gifford, Krass, Sprinkle, Anderson & Citkowski, P.C.

(57) ABSTRACT

The invention relates to a method for setting the cutting gap on a cutting device for cutting food products. According to said method, the actual distance between the blade and the cutting edge is first determined and a desired distance between the blade and the cutting edge is subsequently set by an electric repositioning device, taking into consideration said actual distance.

4 Claims, 2 Drawing Sheets

U.S. PATENT DOCUMENTS

| | | | | |
|---|---|---|---|---|
| 5,628,673 | A * | 5/1997 | Morooka | 451/9 |
| 5,681,204 | A * | 10/1997 | Kawaguchi et al. | 451/9 |
| 6,568,307 | B1 * | 5/2003 | Gunther et al. | 83/367 |
| 6,634,268 | B1 * | 10/2003 | Guenther et al. | 83/13 |
| 6,758,640 | B2 * | 7/2004 | Mizutani et al. | 409/131 |
| 2002/0017174 | A1 * | 2/2002 | Gammerler et al. | 83/13 |
| 2002/0197122 | A1 * | 12/2002 | Mizutani et al. | 409/132 |
| 2004/0011224 | A1 * | 1/2004 | Weber | 99/537 |
| 2004/0231476 | A1 * | 11/2004 | Weber | 83/13 |
| 2007/0028742 | A1 * | 2/2007 | Mueller et al. | 83/676 |

FOREIGN PATENT DOCUMENTS

| | | |
|---|---|---|
| DE | 3544044 | 8/1986 |
| DE | 19518597 | 11/1996 |
| DE | 196 43 261 | 4/1998 |
| DE | 199 33 497 | 1/2001 |
| DE | 100 26 708 | 12/2001 |
| DE | 10037709 | 2/2002 |
| JP | 60-242998 | 12/1985 |

* cited by examiner

METHOD FOR SETTING A CUTTING GAP

FIELD OF THE INVENTION

The present invention relates to a method and to an apparatus for the setting of the cutting gap in a cutting apparatus for the cutting of food products.

BACKGROUND OF THE INVENTION

Such cutting apparatuses usually have a blade rotatably drivable in a cutting plane and a cutting edge. A food product to be cut up is pushed over the cutting edge during the cutting process, whereupon the blade, which can be made as a scythe-type blade or can be driven in a planetary orbiting manner, cuts a product slice from the food product. Since such cutting processes take place today at extremely high speeds and since a large quantity of products is cut within short times, it is desirable to be able to set the cutting gap, i.e. the spacing between the cutting plane and the cutting edge, precisely in order to achieve a good and uniform cutting quality and placing quality as well as good blade service lives.

An automatic positioning of cutting edges in a paper-cutting machine is known from U.S. Pat. No. 4,592,259 in which use is made of a measured reference spacing value.

SUMMARY OF THE INVENTION

It is the object of the present invention to provide a method and an apparatus for the setting of the cutting gap in a cutting apparatus with which the size of the cutting gap can be set automatically and in a simple manner.

In accordance with the invention, for the determination of the actual spacing between the blade and the cutting edge, the blade is moved toward the cutting edge by the adjustment device until a contact takes place. In this process, the current of the adjustment device is measured and the rise in current on the contact between the blade and the cutting edge is used to determine the end position of the blade along the adjustment path. In accordance with the invention, the current of the electric adjustment device, which increases on a contact between the blade and the cutting edge, is used to determine the zero position of the adjustment device. Starting from this zero position or end position of the blade, a desired value of the blade can subsequently be set such that the cutting gap obtains a desired size.

Advantageous embodiments of the invention are described in the description, in the drawing and in the dependent claims.

In accordance with an embodiment of the invention, the blade is not rotated on its movement perpendicular to the cutting plane. It is hereby possible to drive the electric adjustment device at a low speed such that the blade is moved slowly toward the cutting edge until it contacts it, without the blade being damaged in this process.

In accordance with a further advantageous embodiment of the invention, the end position is again determined during operation between the cutting of two sequential food products, whereby it is ensured that the slices of the subsequent food product have the same desired cutting and placing quality as those of the preceding food product.

In accordance with a further embodiment of the invention, the determining of the actual spacing can also take place by a non-contact sensor system, for example by laser scanners, ultrasonic sensors or the like. Such a sensor can be attached to the cutting apparatus and can determine the spacing between the cutting plane and the cutting edge in particular in a non-contact manner. The correction path required to reach a desired position can then be determined from this measurement independently of any dimensional fluctuations of the blade such that the electric adjustment device can move correspondingly.

The invention further relates to an apparatus for carrying out the aforesaid methods, with the electric adjustment device having a path measuring device and a current measuring device with a threshold value detector which emits a signal on the exceeding of a pre-settable threshold value. This signal can, for example, be used to reset the path measuring device to a zero value and to thereby determine an actual spacing of zero.

The present invention will be described in the following purely by way of example with reference to an advantageous embodiment and to the enclosed drawing.

BRIEF DESCRIPTION OF THE DRAWING

The enclosed FIGURE shows a schematic side view of a cutting apparatus for the cutting of food products.

DETAILED DESCRIPTION OF THE PREFERRED EMBODIMENTS

Figure 1:
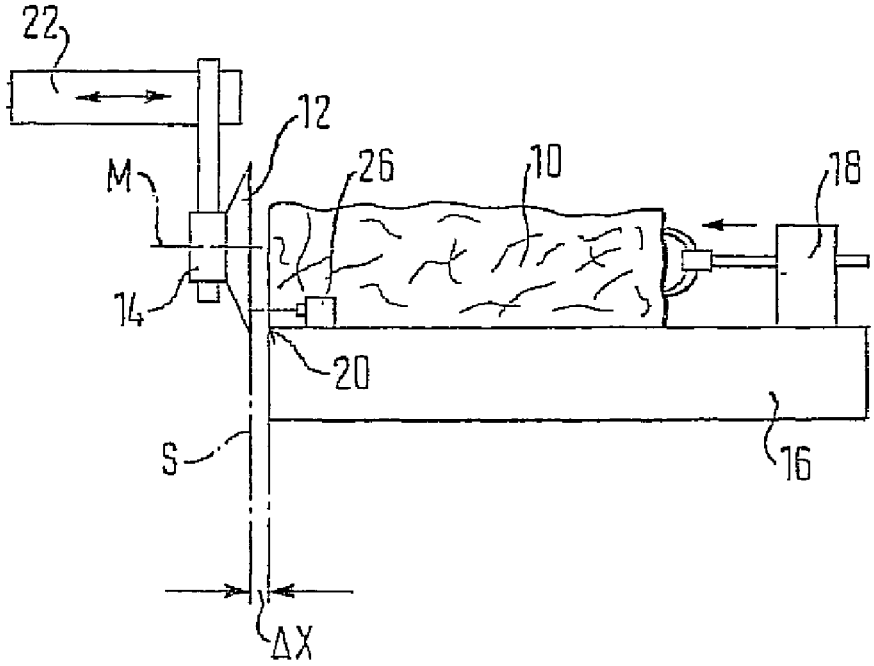
Figure 2:
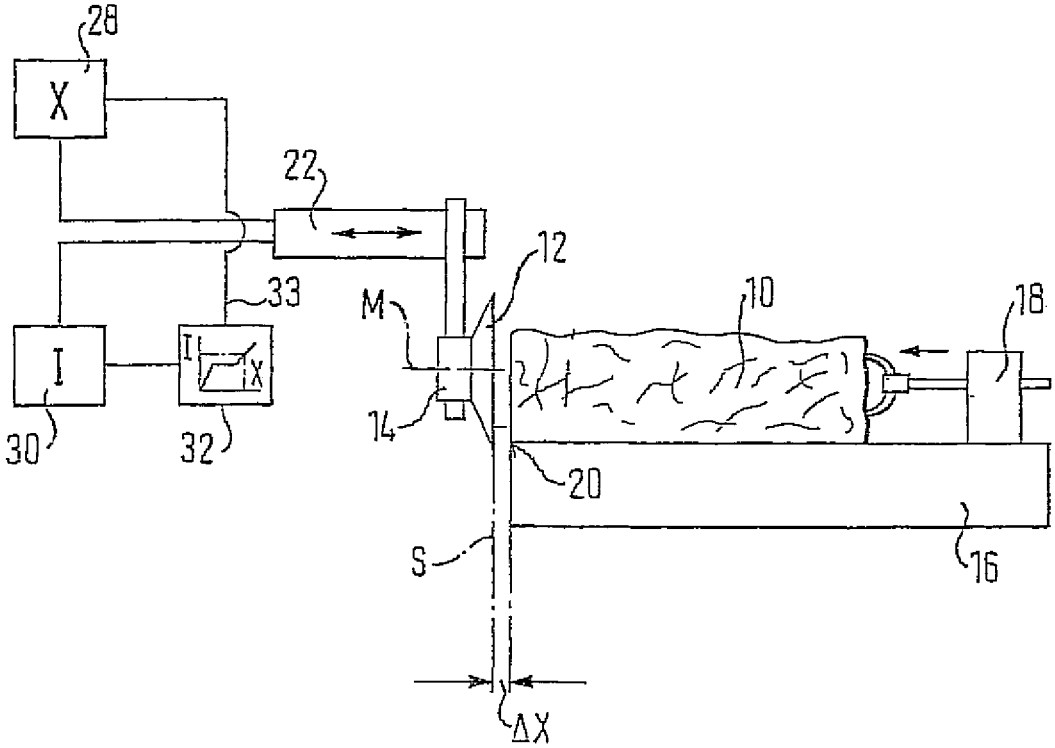

The cutting apparatus shown in the FIGURE for the cutting of a food product 10 has a blade 12 which is rotatably drivable in a cutting plane S and is secured to a blade head 14. The blade head can be driven in a planetary orbiting manner such that the cutting blade 12, additionally to its own rotation, orbits the central axis M of the blade 12 in a planetary orbit in the cutting plane S. Alternatively, a scythe-type blade can be provided for this purpose.

The food product 10 to be cut up lies on a product support 16 on which it is moved by a feed drive 18 in the direction of the cutting plane S. The front end of the product support 16 forms a cutting edge 20 with which the blade 12 cooperates during cutting. A cutting gap $\Delta X$ is formed between the cutting plane S and the cutting edge 20 and is shown in very magnified form in the FIGURE.

The blade head 14 and the blade 12 fastened thereto are displaceably supported on an electric adjustment apparatus 22 such that the blade 12 can be moved toward or away from the cutting edge 20, which is indicated in the FIGURE by a double arrow.

In accordance with an advantageous embodiment of the invention, a non-contact sensor 26 can be provided fixed to the machine in the region of the product support 16 and the spacing between the cutting plane S and the cutting apparatus, and thus also between the cutting plane and the cutting edge 20, can be determined with its aid.

The cutting apparatus in accordance with the invention has a path measuring device 28 and a current measuring device 30 which are in connection with the electric adjustment device 22 and which determine the traveled path X and the current I flowing through the drive of the electric adjustment device 22. A threshold value detector 32 which detects the exceeding of a pre-settable threshold value of the current I of the drive of the electric adjustment device 22 and whose output 33 is connected to the path measuring device 28 is furthermore connected to the current measuring device 30. It is hereby possible to reset the path measuring device to a zero value when it has been detected by the threshold value detector 32 that the pre-set threshold value has been exceeded and thus the end position of the blade 12 has been reached. The path measuring device 28 can be formed in the most varied of ways, for example as a linear encoder or as an incremental counter.

To set a desired spacing ΔX (larger than zero) between the blade 12 and the cutting edge 20, either the actual spacing between the knife 12 and the cutting edge 20 can be determined by the sensor 26, whereupon the wanted desired value can be set. Alternatively to this, it is possible to first move the blade 12 toward the cutting edge 20 by the adjustment device 22 until a contact takes place (actual spacing equal to zero) and to measure the current of the drive of the adjustment device 22 in this process in order to determine an actual spacing ΔX (larger than zero). The current increase on contact can be used by the threshold value detector 32 to emit a threshold value signal via the output 33, whereupon the measuring device 28 can be set to zero. It is subsequently possible, by adjustment of the electric adjustment device 22 away from the cutting edge 20, to set the wanted desired value ΔX.

REFERENCE SYMBOL LIST

10 food product
12 blade
14 blade head
16 product support
18 drive
20 cutting edge
22 electric adjustment device
26 sensor
28 path measuring device
30 current measuring device
32 threshold value detector
33 output
S cutting plane
ΔX cutting gap

The invention claimed is:

1. A method for setting the cutting gap in a cutting apparatus for food products, said cutting apparatus having a cutting edge and a blade rotatably drivable in a cutting plane, said method comprising the steps of:

moving the cutting blade toward the cutting edge by an electric motor until the cutting blade contacts the cutting edge, detecting an increase of electrical current for the motor in excess of a preset threshold amount which is indicative of contact between the cutting blade and the cutting edge, setting a zero position of the cutting blade in response to said detecting step, thereafter moving the cutting blade away from the cutting edge, and sensing the distance of said cutting blade from said zero position.

2. The invention as defined in claim 1 wherein the electric motor comprises a linear drive electric motor.

3. The invention as defined in claim 1 and comprising the step of not rotating the blade during said moving step.

4. The invention as defined in claim 1 and comprising the step of rotating the blade to a predetermined rotational position prior to said moving step.

* * * * *